US005522509A

United States Patent [19]

Shimamura et al.

[11] Patent Number: 5,522,509

[45] Date of Patent: Jun. 4, 1996

[54] METHOD FOR SORTING TABLEWARE OF RESTAURANT, TABLEWARE USED FOR THE SAME METHOD, ADJUSTING APPARATUS AND TABLEWARE SORTING APPARATUS

[75] Inventors: Chikara Shimamura; Masamitsu Kobayashi, both of Tokyo, Japan

[73] Assignee: Sensor Technos Co., Ltd., Tokyo, Japan

[21] Appl. No.: 328,712

[22] Filed: Oct. 21, 1994

[30] Foreign Application Priority Data

Jul. 26, 1994 [JP] Japan ..... 6-174616

[51] Int. Cl.[6] ..... B07C 5/02

[52] U.S. Cl. ..... 209/3.3; 209/524; 209/583

[58] Field of Search ..... 209/3.3, 576, 583, 209/524, 2, 1

[56] References Cited

U.S. PATENT DOCUMENTS 2,910,579 10/1959 Jones et al. .

3,438,489 4/1969 Cambornac et al. ..... 209/576

3,511,372 5/1970 Kantarian et al. ..... 209/583 X

*Primary Examiner*—David H. Bollinger

*Attorney, Agent, or Firm*—Fattibene and Fattibene; Paul A. Fattibene; Arthur T. Fattibene

[57] ABSTRACT

This invention is provided to automate an adjusting job of a restaurant and to realize automatic sorting of tableware and to improve an operating efficiency of a restaurant job. Resonance tags are mounted on bottoms of plates of the tableware in which meals are dished up. The plates are placed on a tray, and the tray is placed on a tray placing position of an adjusting apparatus. A tag reader is buried in a lower portion of the tray placing position, and transmitting antennas and a reception antenna are superposed to form the tag reader. In this case, when radio waves of a plurality of frequencies are oscillated from the transmission antennas, different echo waves are oscillated from the resonance tags of the plates. When the echo waves are received by the reception antenna, the plates are sorted by the resonance frequencies of the resonance tags set to the respective plates. In this case, since a register calculates total amount according to a preset unit price of the meal, the meal on the tray is automatically adjusted.

9 Claims, 11 Drawing Sheets

METHOD FOR SORTING TABLEWARE OF RESTAURANT, TABLEWARE USED FOR THE SAME METHOD, ADJUSTING APPARATUS AND TABLEWARE SORTING APPARATUS

BACKGROUND OF THE INVENTION

This invention relates to method for automatically sorting tableware of a restaurant and, more particularly, to a method for automatically sorting tableware of a restaurant in which adjusting Job and tableware sorting job are automated, an adjusting apparatus and a tableware sorting apparatus.

DESCRIPTION OF THE PRIOR ART

In a conventional cafeteria type restaurant, a user selects one or more plates in which his favorite meals are dished up, places the plates on a tray, and carries the tray to an adjusting place. Then, a person in charge of adjusting presses keys of a register while visually identifying the meals on the tray, and adjusts a total amount to be calculated by the register.

Recently, there is known a system for registering an image pattern in a state that a meal is dished up on a plate, monitoring the meal on the tray by a camera at an adjusting place, and collating the monitored image to the registered image to identify the meal.

Since a person in charge of adjusting visually identifies the meal in the adjusting jog in the conventional cafeteria type restaurant, it needs a processing time of about 14–15 seconds to adjust per one user, and hence is low in a job efficiency. Further, it is necessary to allocate a personnel who is skilled in the adjusting job for the person in charge of the adjusting. Therefore, it is difficult to secure the personnel and causes its cost to increase.

Moreover, since the system for identifying a menu by an image processing cannot sometimes collate in the case where a shape of dish-up of a meal is different from that of the registered image or where sauce or the like is adhered to a plate, it is necessary to allocate a needed personnel at the adjusting place. In addition, it not only requires a great deal of time to register the image of the meal and to dish up the meal, but also raises an introduction price due to necessity of an equipment for replacing with the exclusive use of tableware and treating at a high speed in the case of introduction.

Therefore, technical subject to be solved is raised to automate the adjusting job of a restaurant, to realize an automatic sorting of tableware and to improve an operating efficiency of a restaurant job.

Accordingly, it is an object of this invention to provide a method for automatically sorting tableware of a restaurant which can solve the above-described subject.

SUMMARY OF THE INVENTION

In order to achieve the above-described object, this invention provides a method for automatically sorting tableware of a restaurant by sorting plates of said tableware in which meals selected by a user are dished up in a cafeteria type restaurant, automatically adjusting and automatically sorting said used plates, after cleaning, comprising the steps of placing said plates on a tag reader of an adjusting apparatus or a tableware sorting apparatus, reading echo waves to be transmitted from sad plates via a plurality of radio waves of frequencies to be oscillated from a transmission antenna of said tag reader by a reception antenna, and sorting said plates according to a resonance frequency of said echo waves read by said reception antenna, a tableware to be used for a method for automatically sorting tableware of a restaurant, wherein one or more resonance tags are provided on a bottom of said plate, said resonance tag is formed by printing copper foils in a coil state on both sides of an insulator of a coin shape, and a capacitor is connected to a central end of said copper foil to form a resonance circuit, and an adjusting apparatus and a tableware sorting apparatus to be used for a method for sorting tableware of a restaurant, wherein said adjusting apparatus or said tableware sorting apparatus comprises transmission antennas and reception antennas divided into a plurality of zones and superposed to be buried in said tag reader in such a manner that said plurality of transmission antennas are connected to a transmission amplifier via an antenna switching unit for switching said plurality of transmission antennas at each short time, said reception antenna is connected to a data processor for processing to convert reception data via a reception amplifier, a transmission controller connected between said transmission amplifier and said data processor to synchronize transmission and reception of said radio wave, and said data processor is connected to a display unit, an adjusting processor or a tableware conveyor via a register or a tableware sorting apparatus.

Thus, when the user selects plates in which meals are dished up and places the plates on the tag reader of the adjusting apparatus, radio waves of a plurality of frequencies are oscillated from the transmission antennas of the tag reader, and hence different echo waves are oscillated from the resonance tags of the respective plates provided on the bottoms of the plates. When the echo waves are received by the reception antennas of the tag reader, the plates are sorted according to the resonance frequencies of the resonance tags set to the respective plates. Thereafter, since the register calculates the total amount according to the preset unit prices of the meals.

When the used plates are cleaned, dried, and then placed on the tag reader of the tableware sorting apparatus, the plates are sorted according to the resonance frequencies oscillated from the resonance tags arranged on the respective plates as described above, and sorted by the tableware sorting apparatus and contained in the cup-boards.

BRIEF DESCRIPTION OF THE DRAWINGS

FIG. 2(*b*) is a side view of the resonance tag;

FIG. 3(*b*) is a side view of the tag of FIG. 3(*a*);

DETAILED DESCRIPTION OF PREFERRED EMBODIMENTS

Figure 1:
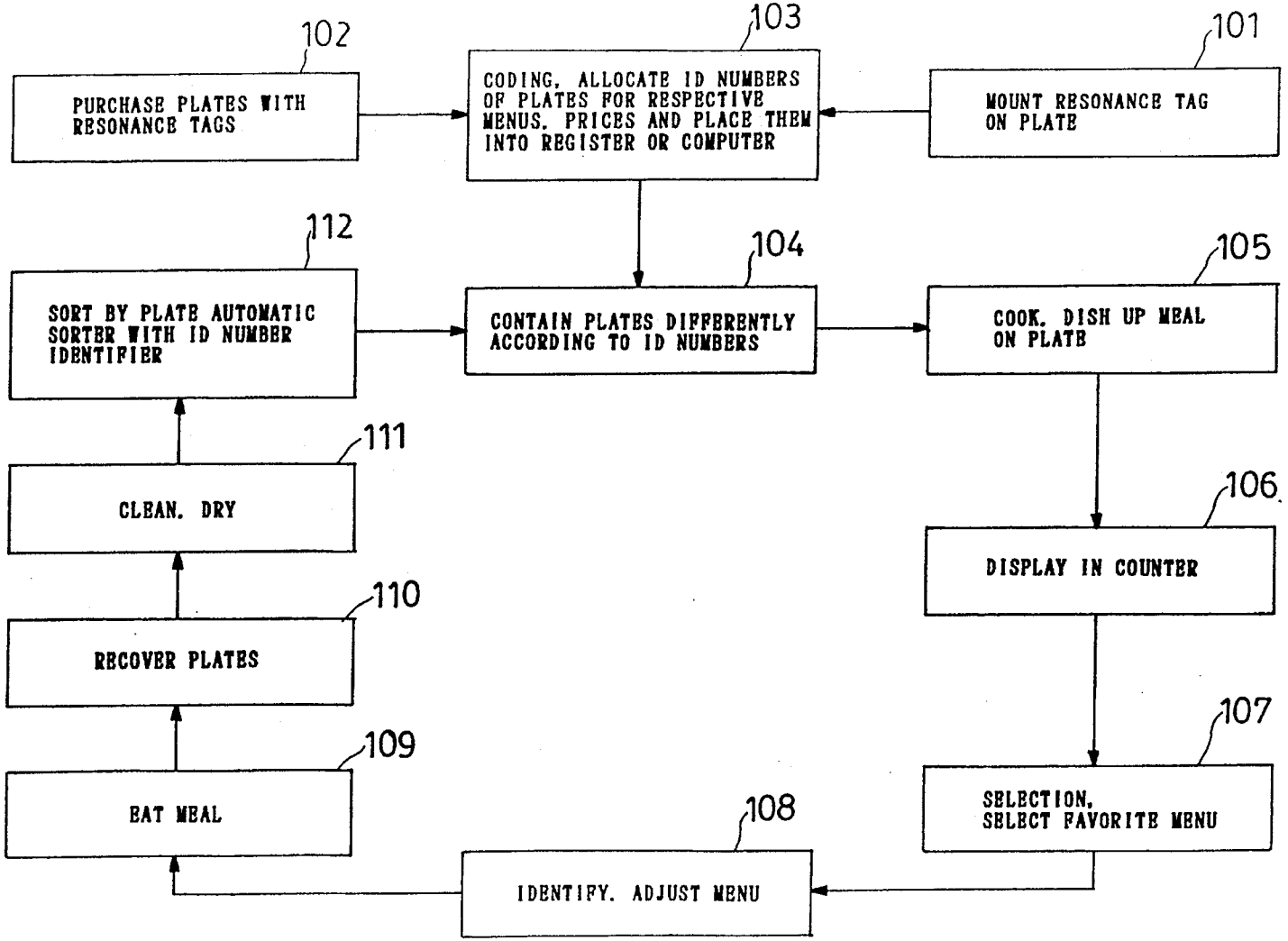
FIG. 1 is a flow chart showing a procedure of a method for automatically sorting tableware according to an embodiment of this invention.

An embodiment of the present invention will be described in detail with reference to FIGS. 1 to 11. FIG. 1 is a flow chart showing a procedure of a method for sorting tableware of a restaurant. First, before the sorting method is used, resonance tags, which will be described later, are respectively adhered to bottoms of all plates of the tableware. At this time, the resonance tags of the same ID number are respectively used for the plates of the same shape (step 101). Or, plates in which the resonance tags are previously buried in the bottoms are prepared (step 102). A coding for allocating ID numbers of the resonance tags mounted on the plates at the respective types to be identified such as a menu, a price and the like of a meal is conducted, and a result of the coding is placed into the register or a computer (step 103). The plates are contained in cup-boards differently according to the ID numbers of the resonance tags (step 104). Cooked meal is dished up on the plate of the corresponding ID number according to the coding (step 105). The dish-up plates are displayed in a counter to be selected by a user (step 106). The user places the plates in which his favorite meals are dished up on the tray (step 107).

When the user who has finished selection of the meal places the tray on a designated tray position of the adjusting apparatus, the ID numbers of the resonance tags mounted on the bottoms of the plates are recognized by the adjusting apparatus. The names, unit prices and total amount of the meals are calculated according to the ID numbers by the adjusting apparatus and displayed on a display unit of the adjusting apparatus. The user adjusts the amount by a prepaid card, an ID card or cash (step 108). The user transports the means in a state that the plates are placed on the tray, and eats the meals (step 109). The user returns the plates to a plate returning place (step 110). The returned plates are cleaned and then dried (step 111). The dried plates are sorted according to the respective ID numbers of the resonance tags by a tableware sorting apparatus (step 112). Then, the process is advanced to a step 104, and the plates are contained in cup-boards differently according to the respective ID numbers of the resonance tags.

Figure 2A:
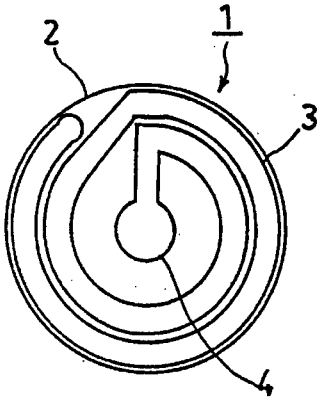
FIG. 2(*a*) is a plan view of a resonance tag used in the method of the embodiment.
Figure 2B:
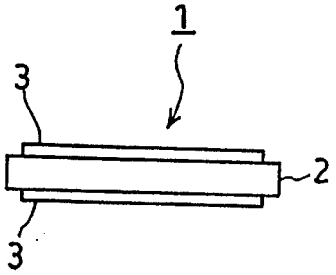
Figure 3A:
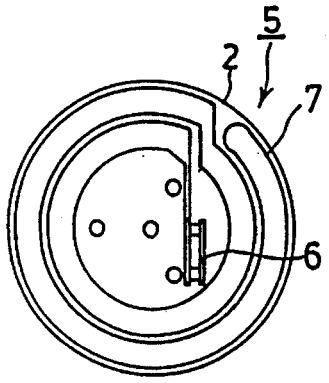
FIG. 3(*a*) is a plan view of other example of the resonance tag.
Figure 3B:
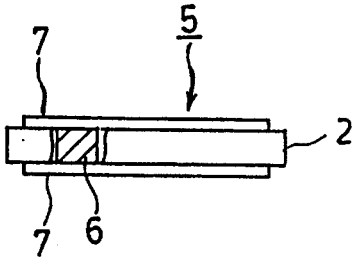

FIGS. 2(*a*), 2(*b*) and FIG. 3(*a*), 3(*b*) show a resonance tag. A resonance tag 1 of FIG. 2(*a*) is formed by providing an insulator 2 of a size like a coin with a circular sheet state and printing a copper foil in a coil state from an outer periphery to both ends of the insulator 2 toward a center thereby to form a resonance circuit formed of a coil 3 and a capacitor 4. A different resonance frequency can be imparted to the resonance tag 1 by altering a shape of the coil 3 of the resonance tag 1 and a capacity of the capacitor 4.

On the other hand, a capacitor 6 of a resonance tag 5 shown in FIGS. 3(*a*) and 3(*b*) is placed by a different member from a coil 7 to form the resonance tag 5 in a composites circuit configuration. The resonance tag 5 can be formed in the same specifications such as a shape and a resonance frequency as those of the resonance tag 1.

Figure 4:
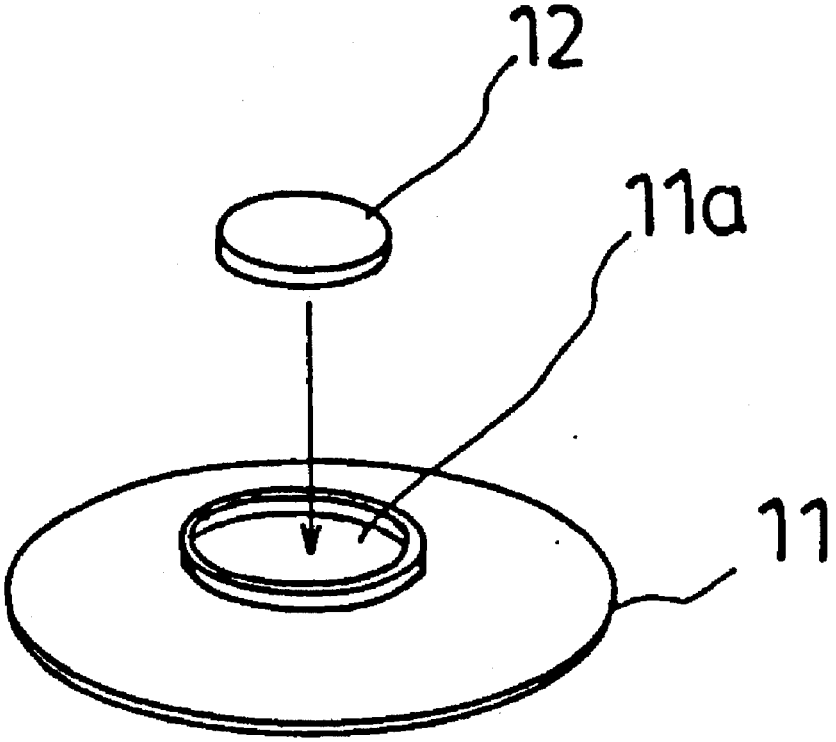
FIG. 4 is an explanatory perspective view showing a state that the resonance tag is adhered to a plate.
Figure 5:
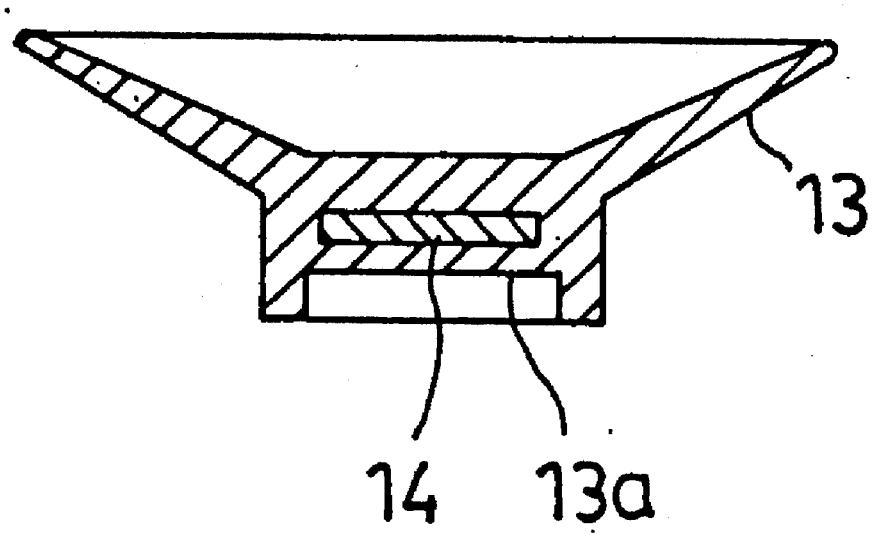
FIG. 5 is a longitudinally sectional view showing a state that the resonance tag is buried in the plate.

FIGS. 4 and 5 show a state that a resonance tag is arranged on a plate. In FIG. 4, a resonance tag 12 is adhered to a recess bottom 11*a* of a plate 11. Since a different resonance frequency is set to the resonance tag 12, different resonance frequencies are respectively applied to ID numbers, and the resonance tags 12 are identified according to the ID numbers. The resonance tags 12 are used to sort the plates 11. For example, the same resonance tags are adhered to the plates of the same shape and the same color.

A plate 13 shown in FIG. 5 is so formed that, when the plate 13 is molded, a resonance tag 14 is buried in a bottom 13*a* of the plate 13.

Incidentally, one or more resonance tags 12 or 14 can be adhered to or buried in one plate. In this case, the types of the plates to be sorted can be increased.

Further, since there is no limit in the shapes of the plates in which the resonance tags 12, 14 are adhered, existing plates can be used.

Figure 6:
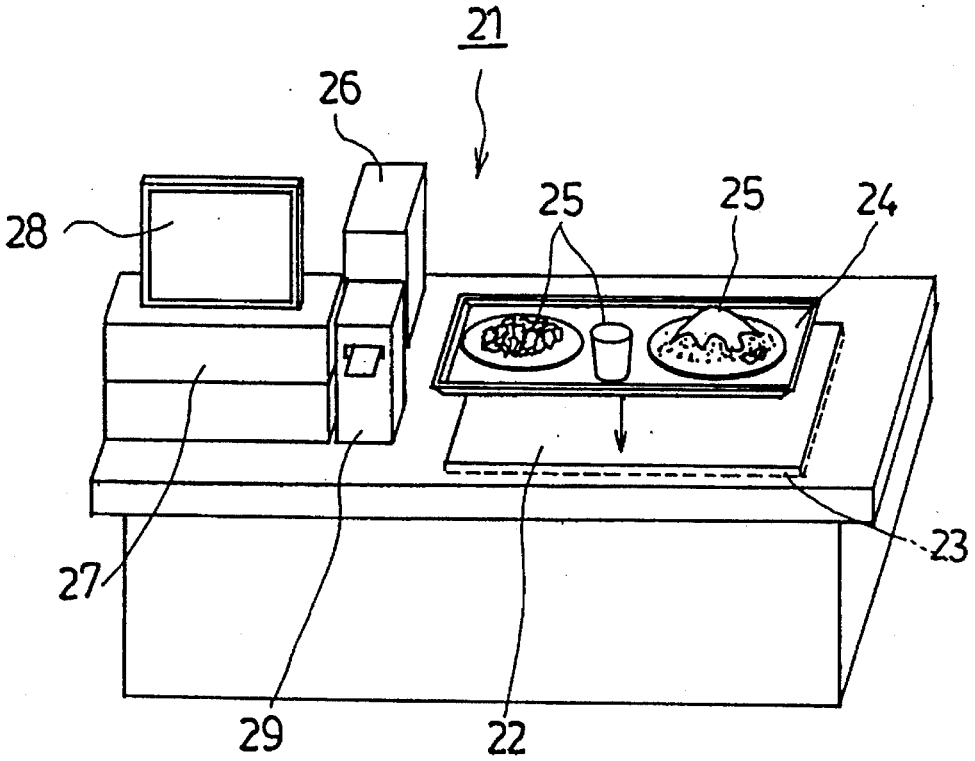
FIG. 6 is a perspective view showing a state that a tray is placed on an adjusting apparatus.

FIG. 6 shows an arrangement of an adjusting apparatus of this invention. A tray placing position 22 is provided on the adjusting apparatus 21, and a tag reader 23, which will be described later, is buried in a lower portion of the tray placing position 22. A tray 24 which places plates 25, 25, . . . is placed on an upper surface of the tray placing position 22. Further, the plates 25, 25, . . . can be placed directly on the tray placing position 22. Thus, the plates 25, 25, . . . mounted with the resonance tags can be identified by the tag reader 23.

The adjusting apparatus 21 has a data processor for controlling sorting of the resonance tag, a control unit 26 for constituting a transmission controller, and a register 27 or a computer (not shown) for storing coded information, collating the meal to the ID number or identifying information of the resonance tag and calculating according to stored coded information. Further, the adjusting apparatus 21 also has a display unit 28 for displaying names, unit prices and total amount of meals, and an adjusting unit 29 such as a card reader for adjusting without using cash.

Figure 7:
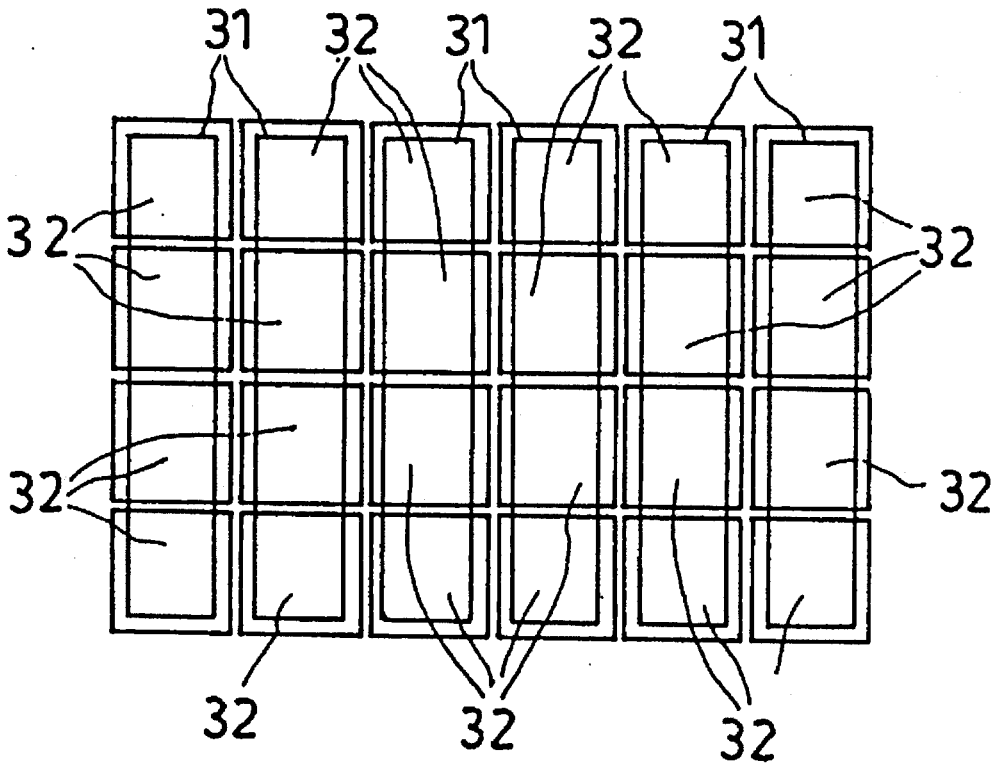
FIG. 7 is an explanatory view showing a state that a transmission antenna and a reception antenna of a tag reader are superposed.
Figure 8:
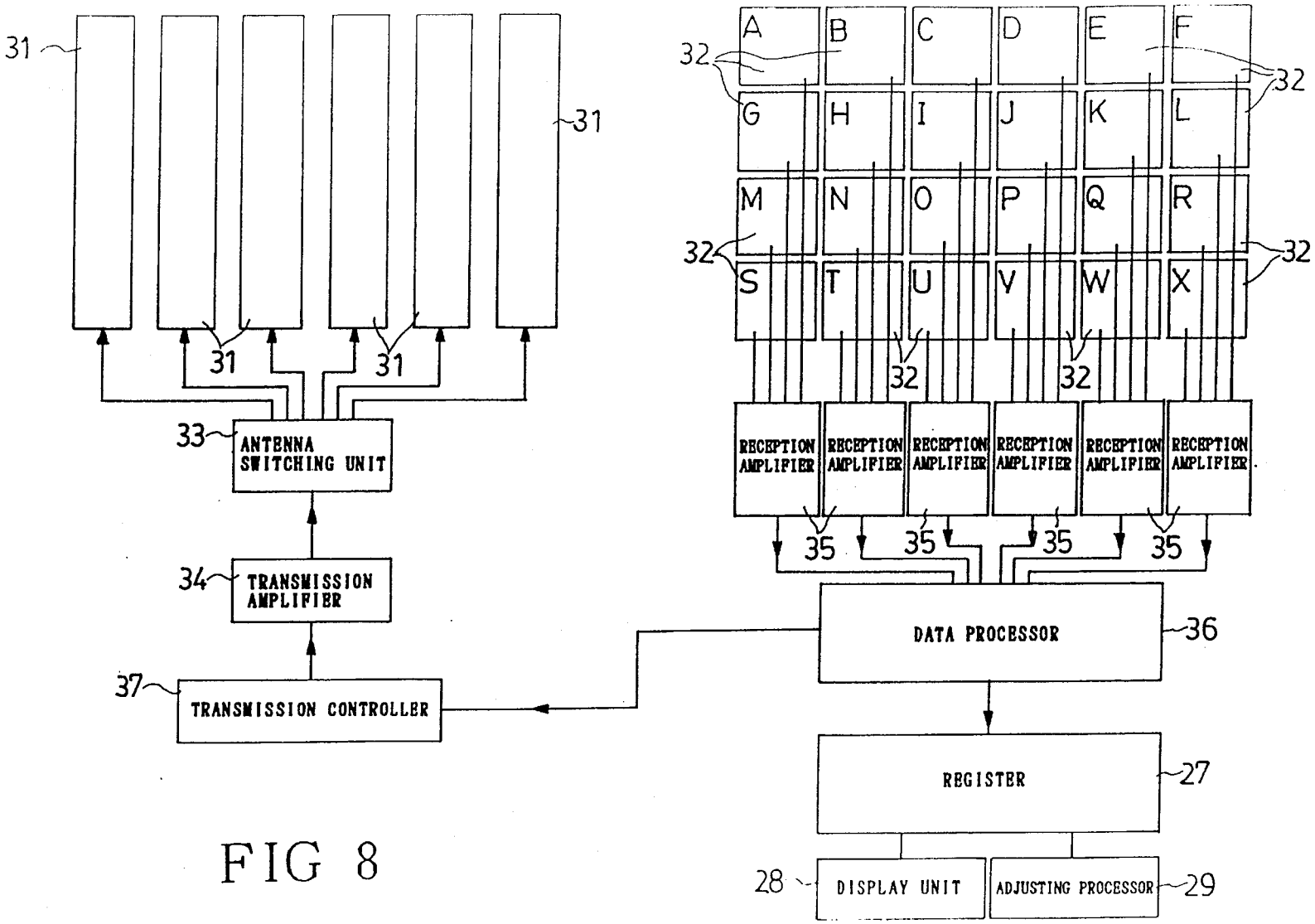
FIG. 8 is a block diagram showing an arrangement of the tag reader.

FIGS. 7 and 8 show an arrangement of the tag reader 23 and the control unit 26. The tag reader 23 formed by superposing transmission antennas 31, 31, . . . and reception antennas 32, 32, . . . is buried in a lower portion of the tray placing position 22 of the adjusting apparatus 21. The transmission antennas 31, 31, . . . transmit radio waves for recognizing the resonance tags, and the reception antennas 32, 32, . . . receive echo waves oscillated from the resonance tags. In this embodiment, the transmission antennas 31, 31, . . . are divided into six rows, which are connected to a transmission amplifier 34 through an antenna switching unit 33. When a radio wave is oscillated from the transmission amplifier 34, the radio wave is switched at an extremely short time by the antenna switching unit 33, and oscillated from the rows of the antennas 31, 31, . . .

The reception antennas 32, 32, . . . are so divided, for example, into a matrix state as to identify the positions of the resonance tags. In this embodiment, the reception antennas 32, 32, . . . are divided into 24 regions. Further, reception amplifiers 35, 35, . . . are respectively connected to the reception antennas 32, 32, . . . to thereby amplify the radio waves received by the reception antennas 32, 32, . . . The reception amplifiers 35, 35, . . . are connected to a data processor 36, which synchronously processes the transmission amplifier 34 and the reception amplifiers 35, 35, . . . via a transmission controller 37 for controlling an operation of the transmission amplifier 34 and processes to analog/digital-convert received data from the reception antennas 35, 35, . . .

The controller unit 26 is formed of the antenna switching unit 33, the transmission amplifier 34, the transmission controller 37, the reception antennas 35, 35, . . . , and the data processor 36. Further, the register 27 is connected to the data processor 36, and the display unit 28 and the adjusting processor 29 are connected to the register 27.

Figure 9:
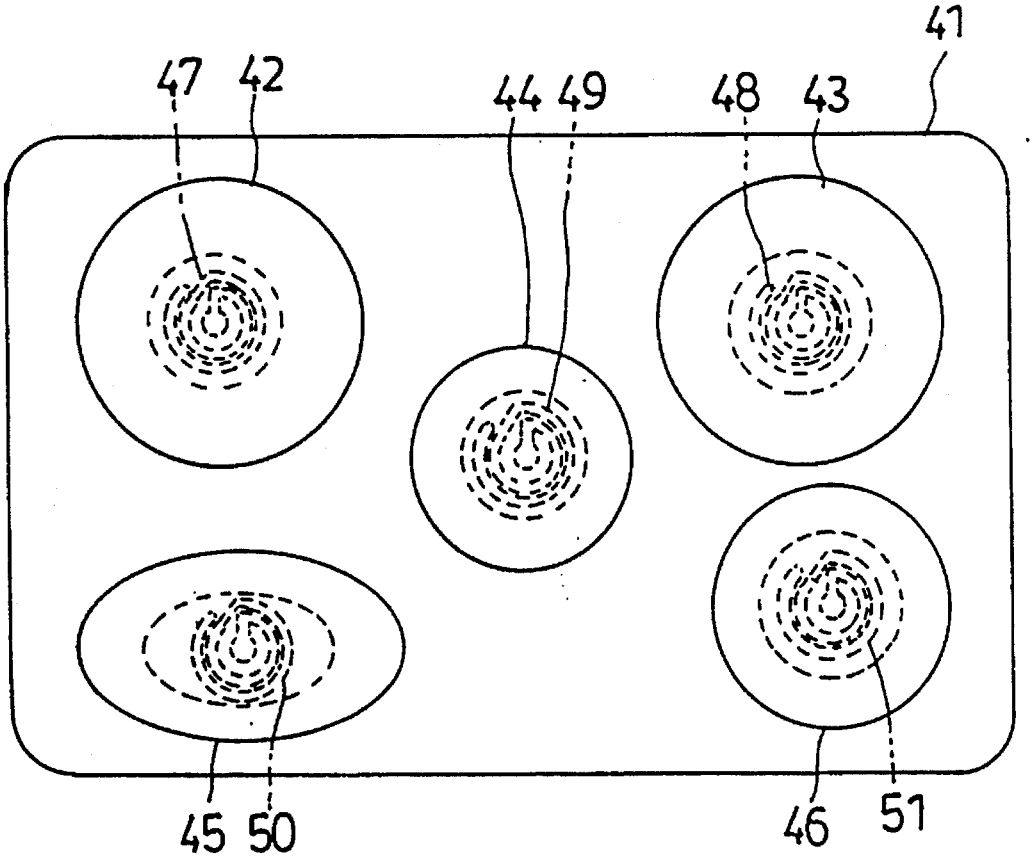
FIG. 9 is a plan view showing a state that places are placed on a tray.
Figure 10:
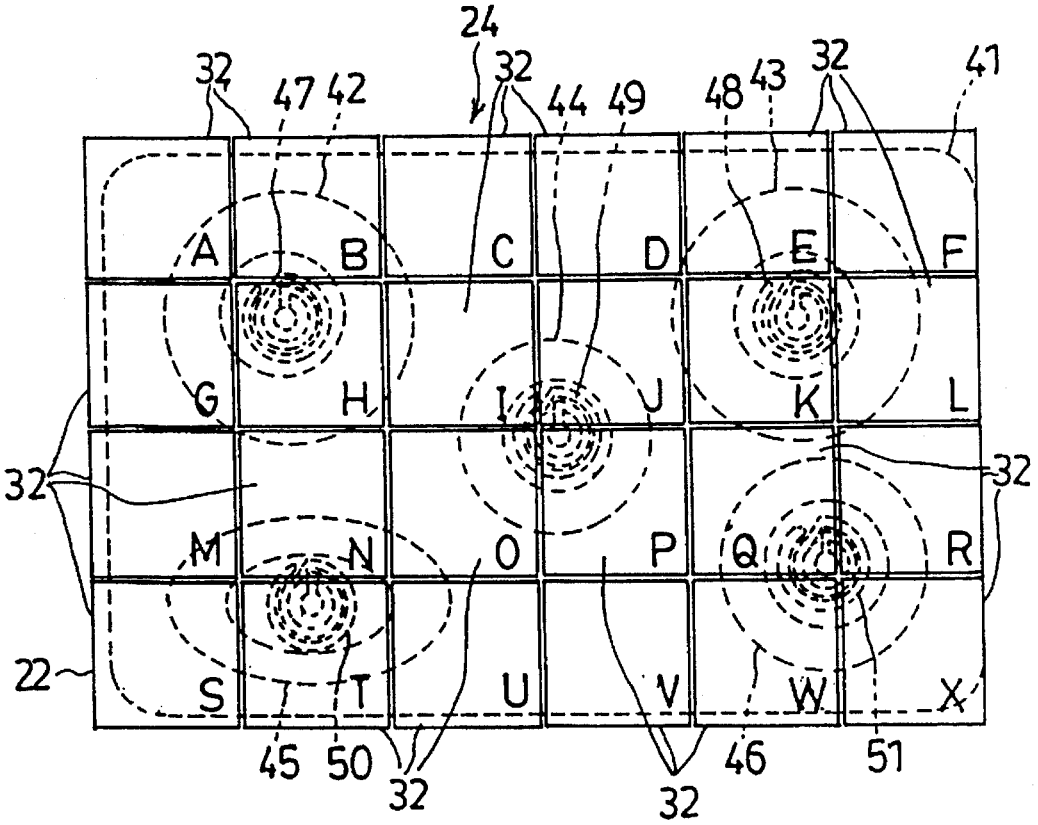
FIG. 10 is a bottom view showing a state that the tray is placed on a tray stock plate.

FIGS. 9 and 10 are concept views in which plates placed on a tray are recognized. As shown in FIG. 9, resonance tags 47, 48, 49, 50, 51 are respectively mounted on plates 42, 43, 44, 45, 46 on a tray 41. Resonance tags 47, 48 in which ID numbers of ID numbers =(1) are applied are respectively mounted on the plates 43, 42 of the shape shape of the plates 42, 43, 44, 45, 46, and resonance tags 49, 50, 51 of ID numbers of ID=(2), ID=(3), ID=(4) are respectively mounted on the plates 44, 45, 46 of different shapes.

FIG. 10 shows a state that the tray 41 is placed on the tray placing position 22 of the above-described adjusting apparatus 21. Since the tag reader 24 is buried in a lower portion of the tray placing position 22, the tray placing position 22 is divided into 24 regions from a region A to a region X via the above-described reception antennas 32, 32, . . . In this case, the resonance tag 47 of the plate 42 is recognized at the ID=(1) on the region H, and the resonance tag 48 of the plate 42 is recognized at the ID–(1) on the region K. The resonance tags 49, 50, 51 of the plates 44, 45, 46 are bridged over a plurality of the regions.

When the above-described resonance tags are bridged over the plurality of regions, the data processor 36 converts the reception signals of the respective reception antennas 32 by a software method such as, for example, a ratio of average of an entirety, specification of individual moving average absolute value, weighting filtering by a timelike change rate and matrix function.

As described above, in the case where the resonance frequency of the same ID number is received by a region of the adjacent reception antennas 32, it is recognized that the resonance tag of the ID number exists on a region where the highest data level is obtained. Thus, the resonance tag 49 of the ID–(2) of the plate 44 is recognized on the region P, the resonance 50 of the ID=(3) of the plate 45 is recognized on the region T, and further, the resonance tag 51 of the ID=(4) of the plate 46 is recognized on the region Q.

Figure 11:
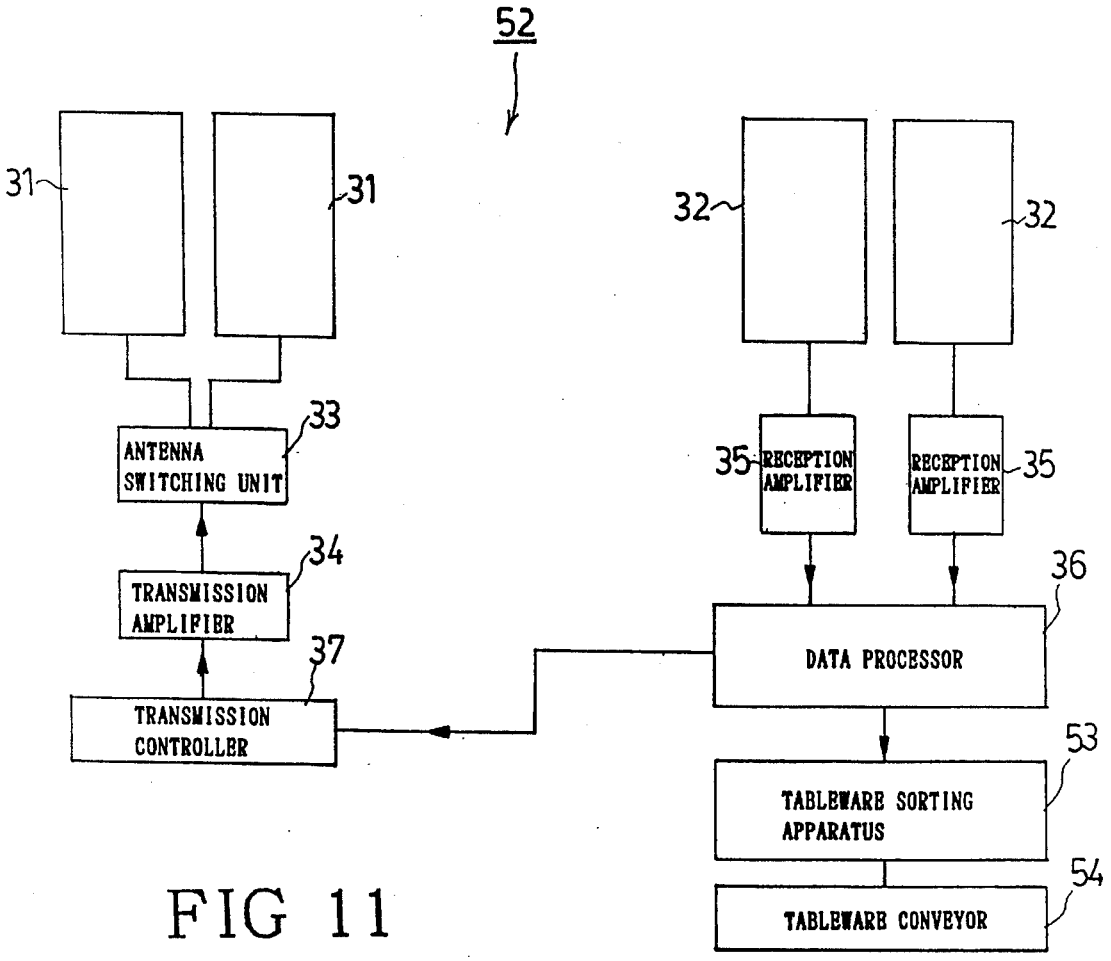
FIG. 11 is a block diagram showing an arrangement of a tableware sorting apparatus.

FIG. 11 shows an arrangement of a tableware sorting apparatus 52. The arrangement of the above-described tag reader 24 and the transmission antenna 31, the reception antenna 32, the antenna switching unit 33, the transmission amplifier 34, the transmission controller 37, the reception amplifiers 35, 35 and the data processor 36 are the same as those described above. In the tableware sorting apparatus 52, the tableware sorting apparatus 53 is connected from the data processor 36 to sort the plates according to the identified ID numbers, and the sorted plates are contained in cup-boards by a tableware conveyor 54.

The present invention may be variously modified within the scope of the spirit of the present invention, and the modifications thereof will be naturally included in the scope of the present invention.

This invention, as described in detail above with respect to the embodiments, places the plates on which meals selected by a user are dished up on the tray similarly to the conventional system, places the tray on the tray placing position of the adjusting apparatus to allow the adjusting apparatus to automatically identify the meals selected by the user, to calculate the total amount and to adjust in several seconds. Therefore, in comparison with the conventional example in which a person in charge of adjusting visually identifies the meals, an adjusting time per one user is largely shortened, and hence an efficiency of adjusting job can be improved. Further, the person in charge of adjusting is eliminated to perform labor-saving.

Since the system in which the resonance tag of the coin state is mounted on the bottom of the plate and the resonance tag does not need a mechanical operation is employed, the resonance tag can be easily waterproofed and sealed to prevent the resonance tag from being moistened with water and damaged, and hence a service of high safety can be provided.

In addition to the adjusting job, since the plates are automatically sorted, after the used plates are cleaned, and contained in the cup-boards, the general automatic management system of the restaurant job can be formed, operating contents can be improved, and further the operability is improved.

We claim:

1. A method for automatically sorting tableware of a restaurant by sorting plates of said tableware in which meals selected by a user are dished up in a cafeteria type restaurant, comprising the steps of:

placing a resonance tag on each of said plates, placing said plates on a tag reader, reading echo waves to be transmitted from said plates via a plurality of radio waves of frequency to be oscillated from a transmission antenna of said tag reader by a reception antenna, and sorting said plates according to a resonance frequency of said echo waves read by said reception antenna.

2. A method for automatically sorting tableware of a restaurant according to claim 1, wherein:

one or more of the resonance tags are provided on a bottom of said plate, said resonance tag is formed by printing copper foils on both sides of an insulator of a coin shape, and a capacitor is connected to a central end of said copper foil to form a resonance circuit.

3. A method for sorting tableware of a restaurant according to claim 1, wherein:

said tag reader comprises transmission antennas and reception antennas divided into a plurality of zones and superimposed in such a manner that said plurality of transmission antennas are connected to a transmission amplifier via an antenna switching unit for switching said plurality of transmission antennas at each short time, said reception antenna is connected to a data processor for processing to convert reception data via a reception amplifier, a transmission controller connected between said transmission amplifier and said data processor to synchronize transmission and reception of said radio wave, and said data processor is connected to a display unit.

4. A system for automatically identifying tableware as used in a restaurant comprising:

a plurality of plates;

a resonance tag placed on each of said plurality of plates;

a tag reader; and a data processor coupled to said tag reader, wherein said resonance tags are identified by said tag reader and said data processor.

5. A system for automatically identifying tableware as in claim 4 further comprising:

adjusting apparatus, said adjusting apparatus using identifying information from said resonance tag and coupled to said tag reader to calculate the total amount of a meal based on stored coded information.

6. A system for automatically identifying tableware as in claim 4 further comprising:

sorting apparatus, said sorting apparatus using identifying information from said resonance tag and coupled to said tag reader to sort said plates.

7. A system for automatically identifying tableware as in claim 4 wherein:

said resonance tag is a coil with a capacitor connected thereto.

8. A system for automatically identifying tableware as in claim 4 wherein:

said tag reader includes transmission antennas and reception antennas divided into a plurality of zones.

9. A system for automatically identifying tableware as used in a restaurant comprising:

a plurality of plates;

a resonance tag placed on each of said plurality of plates, each of said resonance tags including a coil and a capacitor forming a circuit;

a tag reader, said tag reader including a plurality of transmission and receiving antenna divided into a plurality of zones;

a data processor coupled to said tag reader;

adjusting apparatus, said adjusting apparatus using identifying information from said resonance tag and coupled to said tag reader to calculate the total amount of a meal based on stored coded information associated with said data processor; and sorting apparatus, said sorting apparatus using identifying information from said resonance tag and coupled to said tag reader to sort said plates after cleaning, whereby plates are automatically identified facilitating payment for a meal and storage of cleaned plate.

* * * * *